US005826914A

United States Patent [19]

Hudetz

[11] Patent Number: 5,826,914

[45] Date of Patent: Oct. 27, 1998

[54] PERIODICAL INSERT HAVING COMPOSITE STRUCTURE

[75] Inventor: Peter R. Hudetz, Plainfield, Ill.

[73] Assignee: Solar Communications, Inc., Naperville, Ill.

[21] Appl. No.: 715,026

[22] Filed: Sep. 17, 1996

[51] Int. Cl.[6] ..... B42D 15/00

[52] U.S. Cl. ..... 283/61; 283/62; 116/105; 229/92.8

[58] Field of Search ..... 283/61, 62; 116/105; 229/92.8, 300

[56] References Cited

U.S. PATENT DOCUMENTS

| | | | |
|---|---|---|---|
| 1,509,662 | 9/1924 | Barnett . | |
| 1,957,374 | 5/1934 | Unger | 229/92.8 |
| 2,616,612 | 11/1952 | Guttman | 229/92.8 |
| 2,723,078 | 11/1955 | Tilly | 229/92.8 |
| 3,275,316 | 9/1966 | Cleary . | |
| 3,588,085 | 6/1971 | Balley et al. | 270/37 |
| 3,941,309 | 3/1976 | Gendron | 229/73 |
| 4,305,506 | 12/1981 | Greenwald | 206/632 |
| 5,039,132 | 8/1991 | Anderson | 283/61 |
| 5,100,179 | 3/1992 | Burden et al. | 229/92.8 |
| 5,141,252 | 8/1992 | Michlin | 281/15.1 |
| 5,183,203 | 2/1993 | Sanders | 229/300 |
| 5,419,587 | 5/1995 | McClure et al. | 283/56 |
| 5,437,478 | 8/1995 | Gaines | 283/62 |
| 5,667,134 | 9/1997 | Olson et al. | 229/92.8 |

FOREIGN PATENT DOCUMENTS

| | | | |
|---|---|---|---|
| 642595 | 4/1984 | Switzerland | 283/61 |

*Primary Examiner*—Daniel W. Howell
*Assistant Examiner*—Adesh Bhargava
*Attorney, Agent, or Firm*—Andrew R. Basile

[57] ABSTRACT

A composite insert for a magazine or other publication is shown that includes a postal reply card. In one embodiment, the insert has a first portion formed of heavy paper stock suitable for use as a postcard, and a second portion formed of paper stock that is substantially lighter than the first portion. The first portion includes a perforated area defining a detachable postcard. The two portions are superimposed, and joined by a glued seam that is sandwiched between their respective edges. These joined edges are aligned together to define a unitary binding edge. This binding edge may be fed into a standard feeding unit of a perfect or other type binding machine as a single unit.

24 Claims, 4 Drawing Sheets

PERIODICAL INSERT HAVING COMPOSITE STRUCTURE

RELATED APPLICATIONS

This application is a continuation-in-part of Applicant's provisional U.S. patent application, Ser. No. 60/023,443 filed Aug. 21, 1996 now abandoned and entitled "Periodical Insert Having Composite Structure."

FIELD OF THE INVENTION

This invention relates to inserts for periodicals generally, and particularly, to inserts containing postal reply cards.

BACKGROUND OF THE INVENTION

In the printing industry, magazines (such as TV Guide® and Readers' Digest) and other publications often have special advertising inserts that include business reply cards. Under applicable U.S. postal regulations these reply cards must be of a specified thickness, rigidity and weight that is typically greater than other types of pages generally found in magazines. Consequently, the advertising inserts are printed on card stock that is substantially heavier than normal magazine pages to meet postal regulations. Currently, the applicable postal requirement in the United States is that the card stock be at least 0.007 inches thick. Higher requirements are expected in the future. Different jurisdictions have different applicable requirements.

An advertising insert typically consist of two sides folded upon each other along a center spine to create four pages. Since only a small portion of the insert is devoted to the reply card itself, the rest of the insert contains advertising material. One drawback to this arrangement is that the entire insert is made of heavy stock paper. Heavy stock paper is undesirable because in total it costs and weighs more than lighter-weight paper, and in many cases does not yield the same quality printing.

SUMMARY OF THE INVENTION

The object of the present invention is to provide a new type of publication insert that includes a postal reply card, but at the same time is lighter, less expensive and provides higher quality printing surface. In accordance with this object, a first embodiment of a composite insert is provided having a first portion formed of heavy paper stock suitable for use as a postcard, and a second portion formed of paper stock that is substantially lighter than the first portion. The first portion includes a perforated area defining a detachable postcard. The two portions are superimposed, and joined by a glued seam that is sandwiched between their respective edges. These joined edges are aligned together to define a unitary binding edge. This binding edge may be feed into a standard feeding unit of a perfect or other type binding machine as a single unit.

In an alternative embodiment, a composite insert is provided having two side-by-side portions defining a composite binding edge. The first portion is of a thickness suitable for use as a postcard, and includes a binding edge and a perforated area defining a detachable postcard. The second portion includes a plurality of lighter sheets, each having a binding edge. The plurality of lighter sheets is joined along their respective binding edges in booklet like fashion to define a binding edge for the second portion that has the same thickness as the first portion's binding edge. The binding edges from the first and second portions are adjacent and collinear to define an overall composite binding edge, which may be fed into a perfect or other type binding machine.

DETAILED DESCRIPTION OF THE PREFERRED EMBODIMENTS

Figure 1:
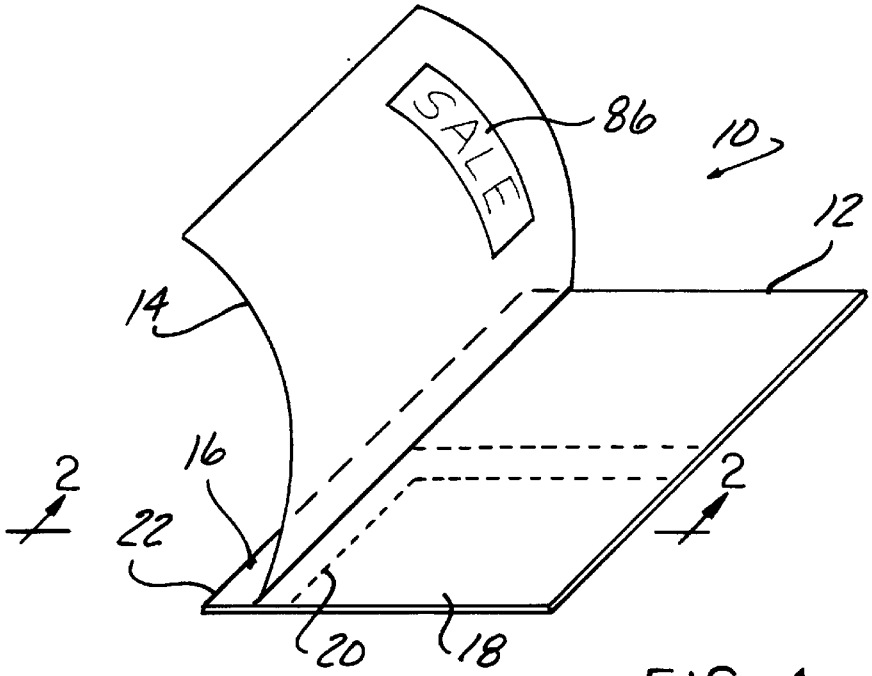
FIG. 1 is a perspective view of an insert in accordance with a first embodiment of the invention.

Referring to FIG. 1, a first insert 10 in accordance with the invention is illustrated. Insert 10 is a composite that includes a heavy stock paper portion 12 and a light stock paper portion 14. Portions 12 and 14 are rectangular, with each measuring 5⅜ inches by 7¾ inches though any sized paper may be used with the invention. Portions 12 and 14 are joined along a glued center seam 16.

Portion 12 is made of a heavy stock seven-point uncoated high-bulk paper of 75 lbs. weight (book basis), while portion 14 is a coated stock having a 32–50 lbs. weight. Heavy stock portion 12 includes a rectangular area 18 defining a postal reply card. Area 18 is demarcated by a line of perforations 20, which enables a reader to conveniently remove reply card 18 from the remainder of heavy stock portion 12. Card 18 is typically industry standard dimensions conforming to postal regulations, which are not necessarily reflected in the drawings. The left lateral side of heavy stock portion 12 defines an approximately 7¾ inch edge 22.

Figure 2:
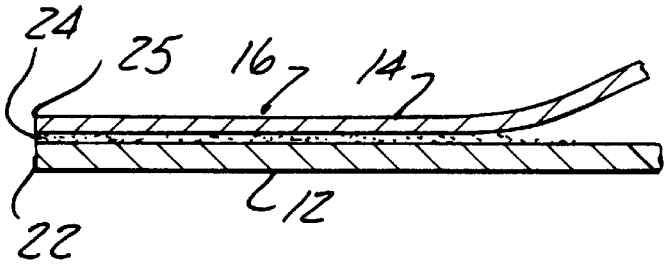
FIG. 2 is a partial cross-sectional view of the insert of FIG. 1 taken along the lines 2-2'.

Seam 16 is formed of a layer 24 of commercially available water-based adhesive (such as spine glue, wet-flap glue or fugitive glue) along the entire extent of edge 22, as shown in FIG. 2. Preferably, adhesive layer 24 is between 0.0625 and 0.50 inches wide. A width of 0.125 inches is suitable for most applications. Adhesive layer 24 may be laid in solid or patterned application. A lateral edge 25 of coated stock portion 14 is aligned with the with adhesive layer 24 so that adhesive layer 24 is sandwiched between heavy stock portion 12 and coated stock portion 14, as best seen in FIG. 2. The remainder of coated stock portion 14 is superimposed over heavy stock portion 12.

The result is that portions 12 and 14 are joined in signature-like fashion, as shown in FIG. 1, so that insert 10 defines a four-page document, with two of the four pages formed by opposing planar faces of heavy stock portion 12, and two of the four pages formed by opposing planar faces of lighter weight stock portion 14. Portion 14 contains printed matter 26 such as advertisements. A reader may respond to printed mater 26 by detaching and mailing reply card 18 from portion 12.

Figure 2A:
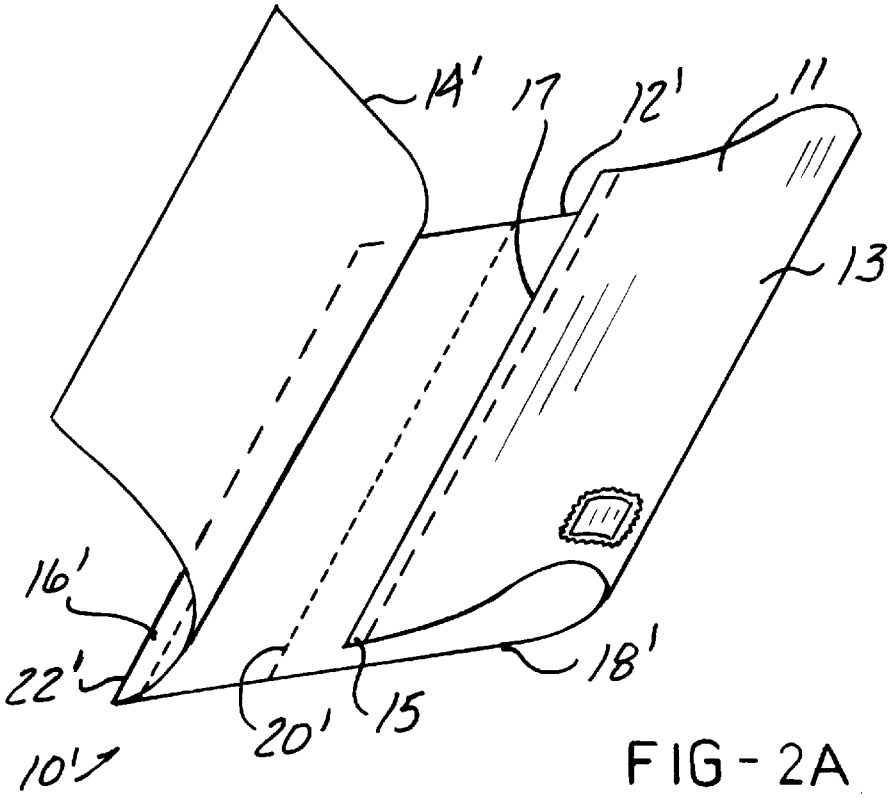
FIG. 2A is a perspective view of modified embodiment of insert of FIG. 1.

FIG. 2A shows an alternative configuration 10' of insert 10. Insert 10' is a composite that includes a first paper portion 12' and an optional light stock paper portion 14'. Portion 14' may be omitted. Portions 12' and 14' are joined in signature-like fashion along a seam 16', the construction of which is comparable to that of seam 16 described above.

The difference between insert 10 and insert 10' is that first paper portion 12' is composed of a single sheet of uncoated lighter stock paper having a book basis weight of between 32 and 50 lbs. Single sheet 12' is wider than its counterpart portion 12 of insert 10 so that it includes over-hanging portion 11 that is folded back over the remainder of portion 12' along a crease 13 to create a mailer 18'. A strip of remoistenable glue 15 is laid along the leading edge 17 of folded-over portion 11 to affix leading edge 17 to the main body of portion 12'.

Mailer 18' is removable from the main body of portion 12' by means of a line of perforations 20'. Crease 13 is formed so that leading edge 17 of folded-over portion 11 lies just adjacent to perforation 20. A reader can conveniently remove all of portion 18' from the remainder of portion 12'. Using remoistenable 15 glue, portion 11 can be fixed in its folded-over position to define a mailer 18' having an overall thickness meeting applicable postal regulations. In this manner, portion 12' may be used to form a business reply mailer without resorting to heavy stock paper. Lighter stock paper of portion 12' is better suited for advertising copy, pictures and other printed matter. Because leading edge 17 is sandwiched between portion 14' and the main body of portion 12', it is able to pass through binding equipment without jamming.

It will be noted that other configurations of folded mailers can be used in accordance with the invention. For example, crease 13 may be folded perpendicular to line of perforations 20'. In that case, portion 11 would extent downward instead of rightward (in the sense of FIG. 2A), and would be folded toward the top of portion 12'. Crease 13 would then extend along the bottom edge of portion 12'.

Figure 3:
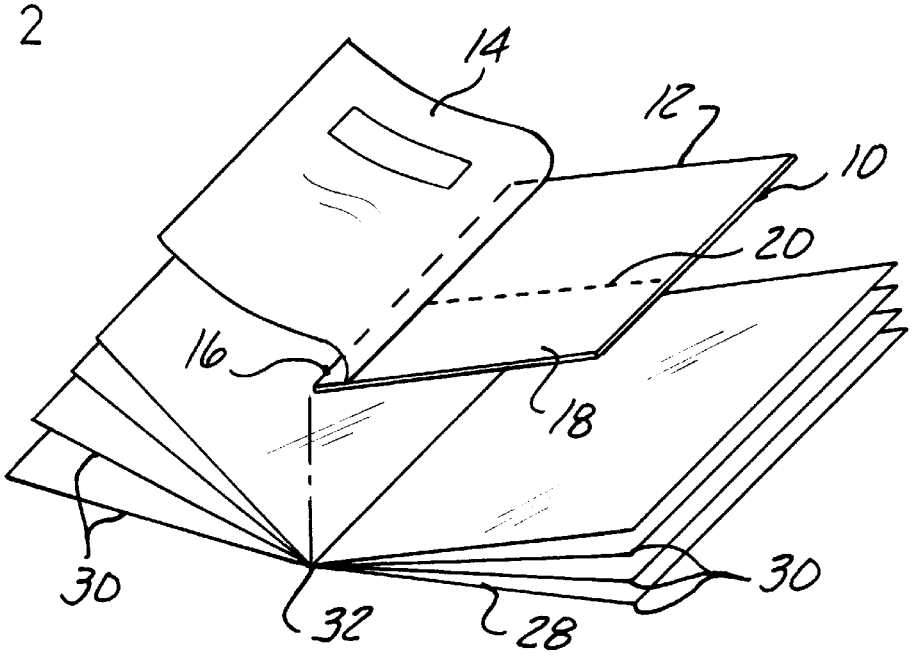
FIG. 3 is an exploded perspective view of a periodical in which the insert of FIG. 1 has been placed.

Referring to FIG. 3, the placement of insert 10 in a publication 28 is shown. Publication 28 may be a periodical such as a magazine. The use of "publication" herein refers to any assemblage of printed matter, whether or not publicly disseminated. Periodical 28 is formed of a plurality of sheets 30 joined along a binding portion 32, which for purposes of illustration is a perfect binding. Patent or square back binding may also be used. Glued seam 16 is aligned with the binding portion of 32 of publication 28, so that insert 10 forms four pages of publication 28.

When binding insert 10 with periodical, insert 10 may be fed as a single unit into a binding machine (not shown) such as a perfect binder. Glued seam 16 presents a single feeding edge of uniform thickness to reduce the chances of jamming the machine. The invention may also be practiced with other similar types of binding techniques.

Figure 4:
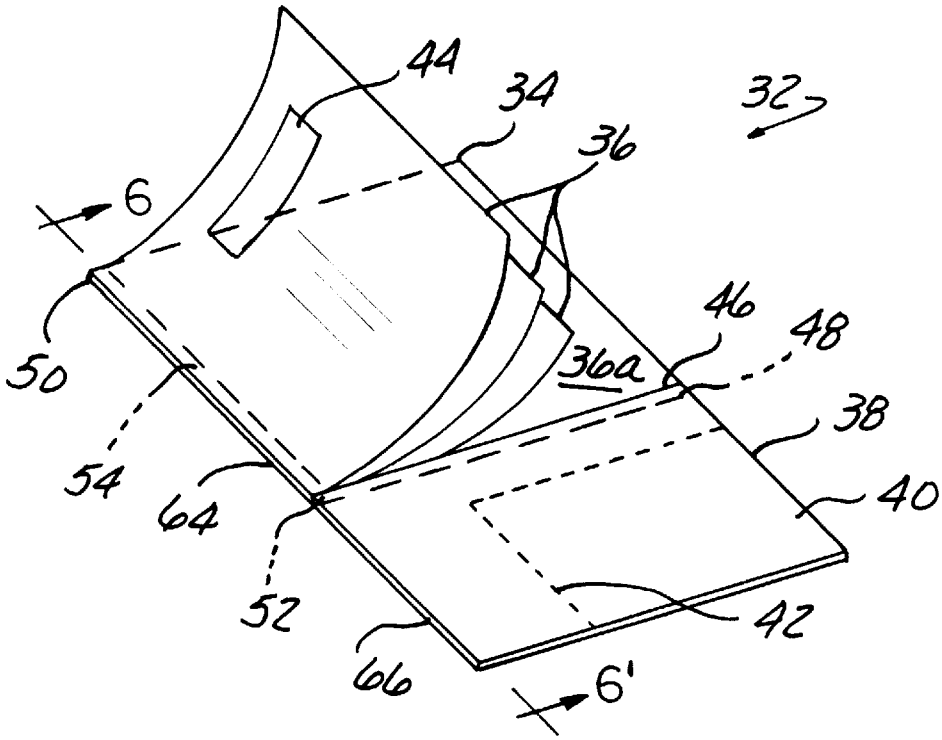
FIG. 4 is a perspective view of an insert in accordance with a second embodiment of the invention.

Referring to FIG. 4, a second embodiment of the invention is illustrated in the form of insert 32. Insert 32 is a composite that includes an multi-ply portion 34 that is made of a plurality of superimposed, light stock sheets 36 and 36*a* comparable to paper portion 14 described above, and a heavy stock portion 38 that is made of a single heavy stock sheet 7 point uncoated high-bulk paper with 75 lbs. weight (book basis). Other weights may be used. Plys 36 and 36*a* are rectangular, and are stacked in rectangular alignment. For purposes of illustration, plys 36 are shown in FIG. 4 turned upwards in the manner of fluttering pages.

Viewed from above (as shown in FIG, 5), portions 34 and 38 are both rectangular in shape, each being approximately 8½ inches long by 6½ inches wide (although the invention may be practiced with portions of other sizes and shapes). The resulting composite measures 8½ inches wide and 11 inches long, suitable for insertion into a bound document having standard 8½ by 11 inch pages.

Heavy stock portion 36 includes a segment 40 used as a reply card and demarcated by a line of perforations 42. The sheets 36 comprising multi-ply portion 34 have printed thereon matter 44 such as advertising. A reader may respond to printed matter 44, 22 by detaching and mailing reply card 40.

Figure 5:
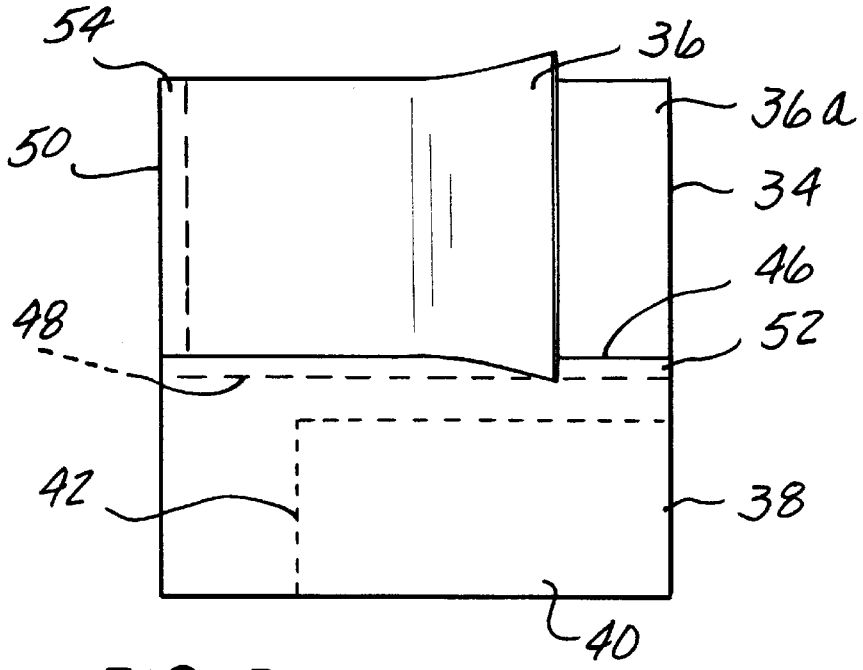
FIG. 5 is a top plan view of the insert of FIG. 4.

Referring to FIG. 5, heavy stock portion 38 defines an upper edge 46 that (in the sense of FIG. 5) extends horizontally 8½ inches. Likewise, bottom-most ply 36*a* defines a lower edge 48 that also extends horizontally 8½ inches. Edge 46 overlaps edge 48 by approximately 0.125 to 0.5 inches. Plys 36 and 36*a* define superimposing left edges 50 that (in the sense of FIG. 5) extends vertically 6½ inches. For clarity, only the top-most one of plys 36 is visible in the plan view of FIG. 5.

Insert 32 is formed by means of two glued seams 52 and 54. Seam 52 joins the bottom-most sheet 36*a* to heavy stock portion 38, and extends between overlapping edges 46 and 48, as shown in FIG. 5. Seam 54 joins the plurality of sheets 36 and 36*a* comprising multi-ply portion 34, and extends along superimposed edges 50 of sheets 36 and 36*a*.

Figure 6:
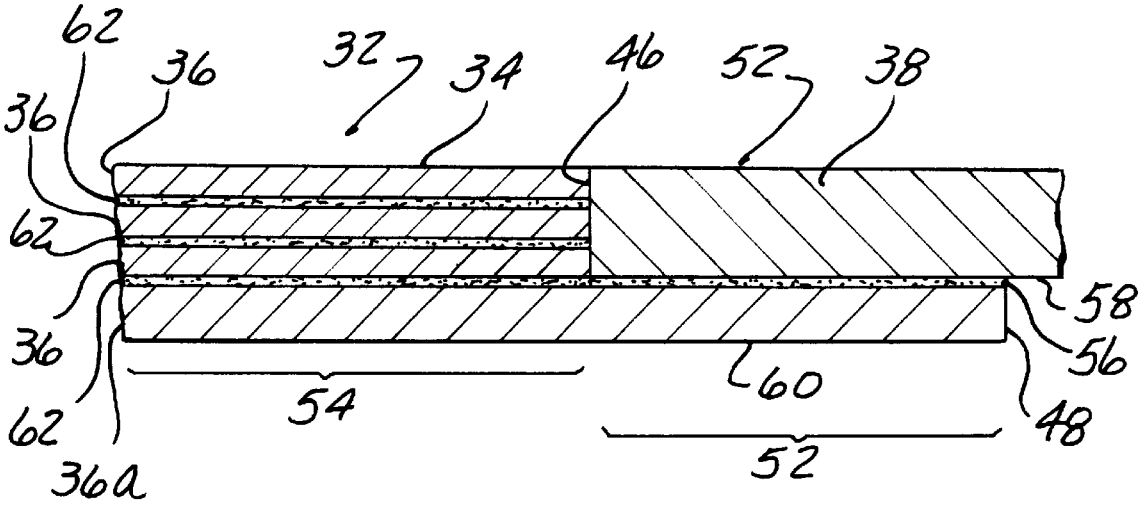
FIG. 6 is a partial cross-sectional view of the insert of FIG. 4 taken along the lines 6-6'.

Referring to FIG. 6, the construction of seams 52 and 54 is shown in greater detail. Seam 52 is formed by laying a 0.125 inch wide ribbon of adhesive 56 over the bottom face 58 of heavy stock portion 38 along the extent of edge 46. Adhesive ribbon 56 is made of water soluble adhesives as described above, and the width of ribbon 56 may vary (although for most applications it should between 0.0625 and 0.5 inches. A 0.125 to 0.25 inch portion 60 of bottom-most sheet 36*a* overlaps the underside 58 of heavy stock portion 38 along the extent of adhesive ribbon 56, so that adhesive ribbon 56 is sandwiched between the underside 58 of heavy portion 38 and overlapping portion 60 of bottom-most sheet 36*a*. The result is that multi-ply portion 34 and heavy stock portion 28 are joined together, and lie side-by-side in substantially the same plane.

Bottom-most sheet 36*a* may be sized slightly larger than the other coated sheets 36 so that the remainder of bottom-most sheet (that is, the portion excluding overlapping portion 60), is of the same size as the other sheets 36. Alternatively, sheets 36 and 36*a* may be cut of different sizes or shapes for desired special effects.

Seam 54 joins the plurality of coated sheets 36 and 36*a* that form multi-ply portion 34. Seam 54 is formed by laying a 0.125 inch wide ribbons 62 of adhesive between each of sheets 36 and 36*a*, along the extent of their respective edges 50, as best seen in FIG. 5 and 6. Note that the sectional view of FIG. 6 is only a partial view of a small portion of insert 32, and consequently, the left edges 50 of plys 36 are not visible.

The result is that sheets 36 and 36*a* are joined in booklet-like fashion, as shown in FIG. 4. Notably, sheets 36 and 36*a* are also attached to heavy stock portion 38 via bottom-most sheet 36*a* and seam 52.

By selecting the proper number of plys 36, an elongated edge 64 of seam 54 can be sized so that it is the same thickness as heavy stock portion 38. Edge 64 is aligned with the left-most edge 66 of portion 38 to form a continuous, straight feeding edge of uniform thickness for feeding insert 32 into a binding machine such as perfect or patent type binding machine.

Figure 7:
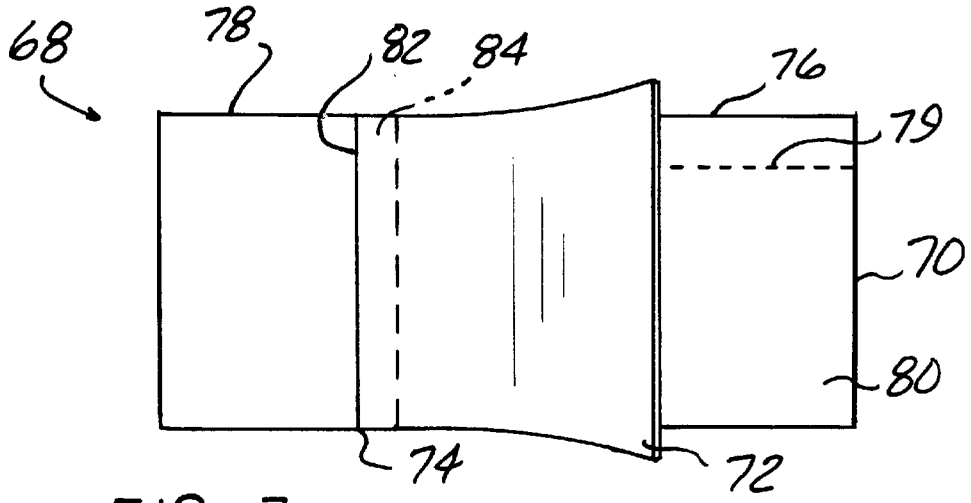
FIG. 7 is a top plan view of an insert in accordance with a third embodiment of the invention.
Figure 8:
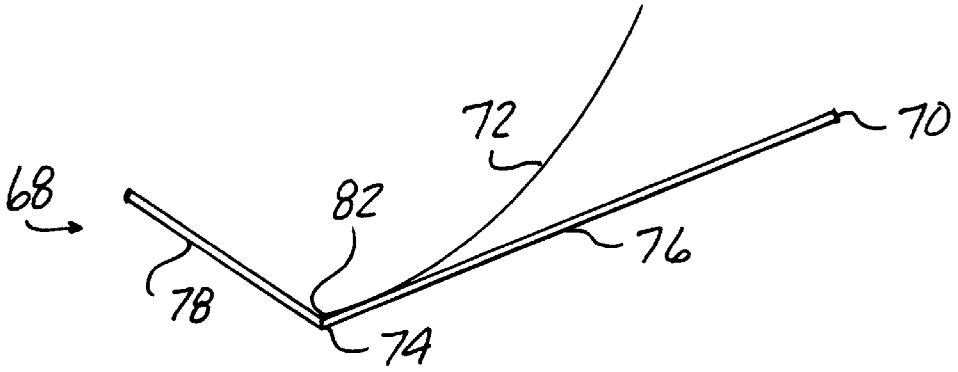
FIG. 8 is a side view of the insert of FIG. 7.
Figure 9:
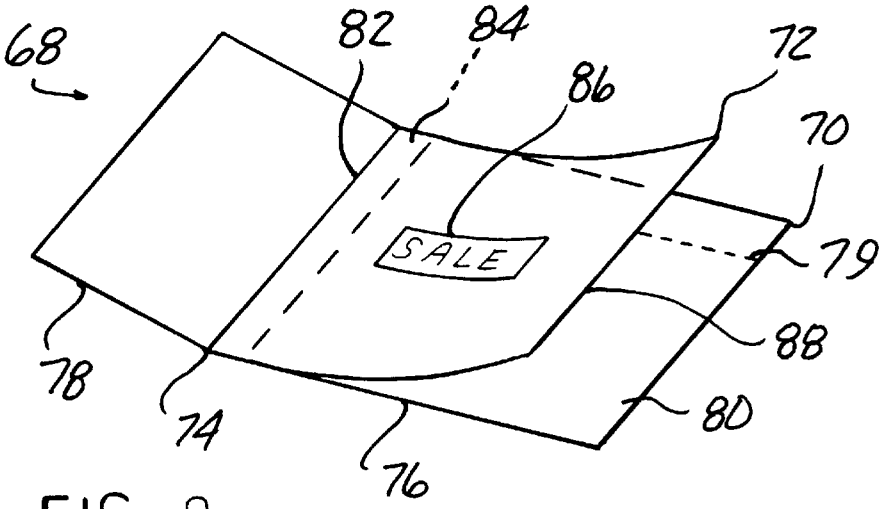
FIG. 9 is a perspective view of the insert of FIG. 7.

Referring to FIGS. 7–9, a third embodiment of the invention is shown in the form of an insert 68 for saddle stitch binding type publications. Insert 68 includes a first portion 70 formed of heavy paper stock suitable for use as a postal reply card and a second portion 72 formed of lighter stock paper. Portion 70 is folded along crease 74 to define a main portion 76 and a sub-portion 78. In binding insert 68 into a saddle stitch type binding, crease 74 will be aligned with the binding, as is known in the industry. Main body 76 includes a perforation 79 defining a detachable portion 80 which may be used as a business reply card.

In accordance with the invention, second portion 72 is superimposed on first portion 70. Second portion 72 includes a lateral edge 82 and this is aligned with crease 74. A ribbon of adhesive 84 is sandwiched between second and first portions 70 and 72 along the longitudinal extent of edge 82 and crease 74. The result is that portion 72 is bound in booklet-like fashion to portion 70. For purposes of illustration, portion 72 is shown in FIGS. 7 through 9 turned upwards in the manner of a fluttering page. Advertising 86 or other printed material may be printed upon portion 72.

Lateral edge 82 and adhesive 84 need not be flush along crease 74, but rather could be shifted to another strip of portion of main body 76, such as for example one inch to the right of crease 74. An optional pat 88 of adhesive can be placed along the right edge 88 of portion 72. When portion 72 is superimposed on the planar face of main body 76, adhesive pat 88 holds portion 72 in place with respect to portion 70 to prevent the flapping depicted in the drawing.

Insert 68 is suitable for use in automated saddle stitch binding equipment, yet provides a composite construction that allows a portion (namely portion 72) to be formed of lighter stock material that weighs less and may be coated to provide higher quality printing for advertising and the like.

I claim:

1. A composite insert for a publication comprising:

a first planar portion having a first edge and being of a thickness meeting applicable postal authority regulations prescribing the required thickness of postcards;

said first planar portion having on its planar face a plurality of perforations defining a detachable area that is of a size and shape suitable for use as a postcard;

a second planar portion that is less thick than said first planar portion and has a second edge; and an adhesive ribbon located along said first edge;

wherein said second planar portion is superimposed on the face of said first planar portion with said first and second edges aligned so that said adhesive ribbon is sandwiched between said first and second edges to join said first and second planar portions; and wherein said first and second edges as joined by said adhesive form a unitary binding edge.

2. The insert of claim 1 wherein said first planar portion is uncoated, high-bulk stock paper having a thickness of at least 0.007 inches.

3. The insert of claim 2 wherein said first planar portion has a book basis weight of at least 75 lbs.

4. The insert of claim 2 wherein said second planar portion is coated stock paper having a book basis weight of no more than 50 lbs.

5. The insert of claim 1 wherein said adhesive ribbon is discontinuous.

6. The insert of claim 1 wherein said unitary binding edge is of a uniform thickness measured along the dimension perpendicular to said unitary binding edge's longitudinal extent.

7. An assemblage of printed matter comprising:

a plurality of pages, each having a binding edge;

an insert having a first paper portion having a first edge portion, a second paper portion less thick than said first paper portion and having a second edge, and an adhesive ribbon along said first edge, wherein said second paper portion is superimposed on said first paper portion with said first and second edges aligned so that said adhesive ribbon is sandwiched between said first and second paper portions to form a unitary insert binding edge; and a bind joining said insert and said plurality of pages along their respective binding edges;

wherein said first paper portion includes a detachable portion that is of a size and shape suitable for use as a post card; and wherein said first paper portion is at least as thick as the thickness required for post cards under applicable postal regulations.

8. The assemblage of claim 7 wherein said first portion is at least 0.007 inches thick.

9. The assemblage of claim 7 wherein said detachable portion is defined by a plurality of perforations in said first paper portion.

10. The assemblage of claim 7 wherein said first paper portion is of heavy stock having a book basis weight of at least 75 lbs.

11. The assemblage of claim 7 wherein said second paper portion is coated stock having a book basis weight of no more than 50 lbs.

12. The assemblage of claim 7 wherein said bind is fabricated as a perfect bind.

13. The assemblage of claim 7 wherein the binding edges of each of the plurality of pages are formed by folding each page in half to define a four-page signature.

14. A method for binding an insert having a detachable postcard into a publication having a plurality of other pages joined along their respective binding edges, comprising the steps of:

providing a first paper portion that is at least 0.007 inches thick and has a side edge;

perforating an area of said first paper portion to define a detachable post card;

providing a second paper portion that is less thick than said first paper portion and has a side edge;

joining said first and second paper portions together along their respective side edges to form a signature having composite binding edge defined by the respective side edges of said first and second paper portions; and binding said binding edge of said signature with the other binding edges of the plurality of other pages in the publication.

15. The method of claim 14 wherein the thickness of said first paper portion is at least as great as the thickness required for postcards under applicable postal regulations.

16. The method of claim 14 wherein the step of binding the binding edges of said signature and the plurality of other pages is accomplished using a perfect binding technique.

17. The method of claim 14 where said first paper portion is heavy stock paper having a book basis weight of at least 50 lbs.

18. The method of claim 14 wherein the step of joining said first and second paper portions is accomplished by applying a layer of glue along said side edges of said first and second paper portions so that said layer of glue is sandwiched in between said side edges.

19. A composite insert for a publication comprising:

a first portion having a single ply that is of a thickness meeting applicable postal authority regulations prescribing the required thickness of postcards; wherein said single ply defines a first binding edge and a first joining edge;

a second portion having a plurality of superimposed plys each having a thickness less than said single ply of said first portion; wherein the thickness of said second portion is approximately equal to the thickness of said first portion, and wherein said plurality of superimposed plys define a second binding edge and a second joining edge;

connecting means for connecting said first portion and said second portion along their respective first and second joining edges;

wherein said first and second binding edges are adjacent and collinear to define an unitary binding edge of approximately uniform thickness when said first and second portions are connected by said connecting means.

20. The composite insert of claim 19 wherein said plurality of plys in said second portion are bound together in booklet-like fashion along said second binding edge.

21. An insert comprising:

a first paper portion having a crease dividing said first paper portion into a main and subsidiary component, said first paper portion being of a thickness meeting applicable postal authority regulations prescribing the required thickness of postcards;

said first paper portion having on the planer face of its main component a plurality of perforations defining a detachable area that is of a size and shape suitable for use as a postcard;

a second paper portion that is less thick than said first paper portion and has a first edge; and an adhesive ribbon located on said main component along said crease;

wherein said second paper portion is superimposed on the main component of said first paper portion with said crease aligned so that said adhesive ribbon is sandwiched between said first portion and said edge of said second portion to join said first and second paper portion.

22. An insert comprising:

a first paper portion having a first edge, and a plurality of perforations on said first paper portion defining a detachable area having a crease; wherein said detachable area is of size, thickness and shape suitable for mailing when folded along said crease;

a second paper portion that is less thick than said first paper portion, having a second edge;

and a first adhesive ribbon located along said first edge; wherein said second paper portion is superimposed on the face of said first paper portion with said first and second edges aligned so that said adhesive ribbon is sandwiched between said first and second edges to join said first and second paper portions;

and wherein said first and second edges as joined by said adhesive form a unitary binding edge.

23. The insert of claim 22 wherein said plurality of perforations form a line that is parallel to said crease.

24. The insert of claim 22 wherein said plurality of perforations form a line that is perpendicular to said crease.

* * * * *